US005349784A

United States Patent [19]

Grois et al.

[11] Patent Number: 5,349,784

[45] Date of Patent: Sep. 27, 1994

[54] OPTICAL FIBER POLISHING APPARATUS

[75] Inventors: Igor Grois, Northbrook; Ilya Makhlin, Skokie; Mark Margolin, Lincolnwood, all of Ill.

[73] Assignee: Molex Incorporated, Lisle, Ill.

[21] Appl. No.: 911,837

[22] Filed: Jul. 10, 1992

[51] Int. Cl.[5] ..... B24B 11/00

[52] U.S. Cl. ..... 451/314; 451/365; 451/392; 451/41; 451/59; 451/490

[58] Field of Search ..... 51/58, 64, 121, 124 R, 51/125, 150, 151, 154, 217 R, 217 S, 230, 237 M, 283 R, 328, 358

[56] References Cited

U.S. PATENT DOCUMENTS

| | | | |
|---|---|---|---|
| 3,892,091 | 7/1975 | Hutchins | 51/358 |
| 3,897,657 | 8/1975 | Smith | 51/125 |
| 4,291,502 | 9/1981 | Grimsby | 51/125 |
| 4,905,415 | 3/1990 | Moulin | 51/217 S |
| 5,007,209 | 4/1991 | Saito et al. | 51/283 R |
| 5,136,820 | 8/1992 | Luther | 51/283 R |
| 5,140,779 | 8/1992 | Grois | 51/217 R |
| 5,184,433 | 2/1993 | Maack | 51/283 R |

FOREIGN PATENT DOCUMENTS

| | | | |
|---|---|---|---|
| 45-5520 | 2/1970 | Japan | 51/125 |

*Primary Examiner*—Jack Lavinder
*Attorney, Agent, or Firm*—A. A. Tirva

[57] ABSTRACT

An apparatus is provided for polishing the end face of an optical fiber encapsulated within a ferrule portion of a fiber optic connector device which terminates the optical fiber. The end of the optical fiber projects from the ferrule portion. A mounting plate has a forward surface and a receptacle for mounting the connector device, with the end of the optical fiber projecting from the forward surface, to permit the end face to be polished by moving the mounting plate over an appropriate polishing surface. A polishing plate forms a substrate having a recess in a forward surface thereof. A polishing film is adhered to the substrate, spanning the recess, to define an air space beneath the film in the recess. Therefore, the mounting plate can be positioned over the polishing plate to align the end of the optical fiber with the recess, in engagement with the polishing film spanning the recess, to permit the end face of the optical fiber to be polished by moving the forward surfaces of the mounting plate and the polishing plate relative to each other.

5 Claims, 3 Drawing Sheets

OPTICAL FIBER POLISHING APPARATUS

FIELD OF THE INVENTION

This invention generally relates to the art. of optical fibers and, particularly, to a tool or apparatus for polishing the end faces of optical fibers.

BACKGROUND OF THE INVENTION

In the optical fiber art, lightguide fibers are used in optical transmission systems wherein the fibers are connected end-to-end to transfer light therebetween. The fibers usually are terminated in connectors which center tile fibers to provide low insertion losses. The connectors are coupled together so that their encapsulated fibers connect or abut end-to-end.

Optical fiber connectors often include a connector body, a forwardly projecting ferrule of ceramic or other rigid material, and a connecting member for coupling the connector to a complementary connector. The fiber projects slightly from the distal end of the ferrule.

Signal loss can be encountered because light is lost if the end faces of the connected fibers are separated at a gap or because light diverges as it radiates from one or both of the fibers. Consequently, it has become conventional and necessary to polish the end faces of the fibers which protrude beyond the connector ferrules prior to incorporation of the connectors into an optical fiber transmission system.

Various problems have been encountered for many years with optical fiber polishing tools or machines. For instance, when the end faces of fibers are polished over a relatively rigid polishing surface, the protruding fiber ends often become damaged or broken during polishing and often become over-polished which leaves little or no margin for error in establishing a good abutting relationship between opposing ends of a pair of mating fibers. It also has been found that transmission losses occur when the ends of the fibers are polished in a generally flat plane, because of gaps created when the flat end faces are not precisely parallel.

Consequently, attempts have been made to employ polishing surfaces which are backed by resilient material, such as a foam material, so that the polishing surface is resilient or yielding. Such "soft" polishing surfaces tend to lessen the previously encountered damage to or overpolishing of the fiber ends. In addition, such soft polishing surfaces create a convex polished end on an optical fiber so that a pair of abutting fibers are ensured to engage without a gap therebetween. However, such resilient or soft polishing surfaces have been inconsistent, the resilient materials, such as foam backings, tend to age and deteriorate, and the resulting polished fibers simply have not been totally acceptable.

This invention is directed to solving the above problems by providing an improved optical fiber polishing apparatus which has a yielding polishing surface to prevent damage to or breakage of the fiber ends, to prevent overpolishing of the fiber ends, and to provide a consistent medium to effect consistent convex polishing of the end faces of the fiber ends.

SUMMARY OF THE INVENTION

An object, therefore, of the invention is to provide a new and improved optical fiber polishing apparatus of the character described.

In the exemplary embodiment of the invention, the apparatus is disclosed for polishing the end face of an optical fiber located within a ferrule portion of a fiber optic connector device which terminates the optical fiber. The end of the optical fiber projects from the ferrule portion. The apparatus includes mounting means having a forward surface and a receptacle for mounting the connector device, with the end of the optical fiber projecting from the forward surface to permit the end face to be polished by moving the mounting means over an appropriate polishing surface. Polishing means are provided with a substrate having a recess in a forward surface thereof. A polishing film is positioned on the substrate, spanning the recess to define an air space in the recess beneath the film. Therefore, the mounting means can be positioned over the polishing means to align the end of the optical fiber with the recess, in engagement with the polishing film spanning the recess, to permit the end face of the optical fiber to be polished by moving the forward surfaces of the mounting means and the polishing means relative to each other. The air confined in the recess beneath the polishing film effectively allows the film spanning the recess to be flexible or "soft", and the air provides a consistent medium which does not age, deteriorate or require replacement as in polishing tools heretofore available.

More particularly, the polishing film has adhesive means on a back side thereof for adhering to the forward surface of the polishing means. The polishing film has a lapping compound on a forward side thereof for engagement by the end face of the optical fiber. The lapping compound may be made up of fine abrasives bonded to the forward side and moistened with olive or lard oil or the fine abrasives may be introduced with the oil. The mounting means include spring means for spring loading the receptacle to permit yielding of the end of the optical fiber on engagement with the polishing film.

Another feature of the invention is providing the receptacle of the mounting means in the form of a resilient sleeve for gripping the ferrule portion of the fiber optic connector device. The sleeve is generally cylindrical and is at least in part axially slit to provide resiliency therefor.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
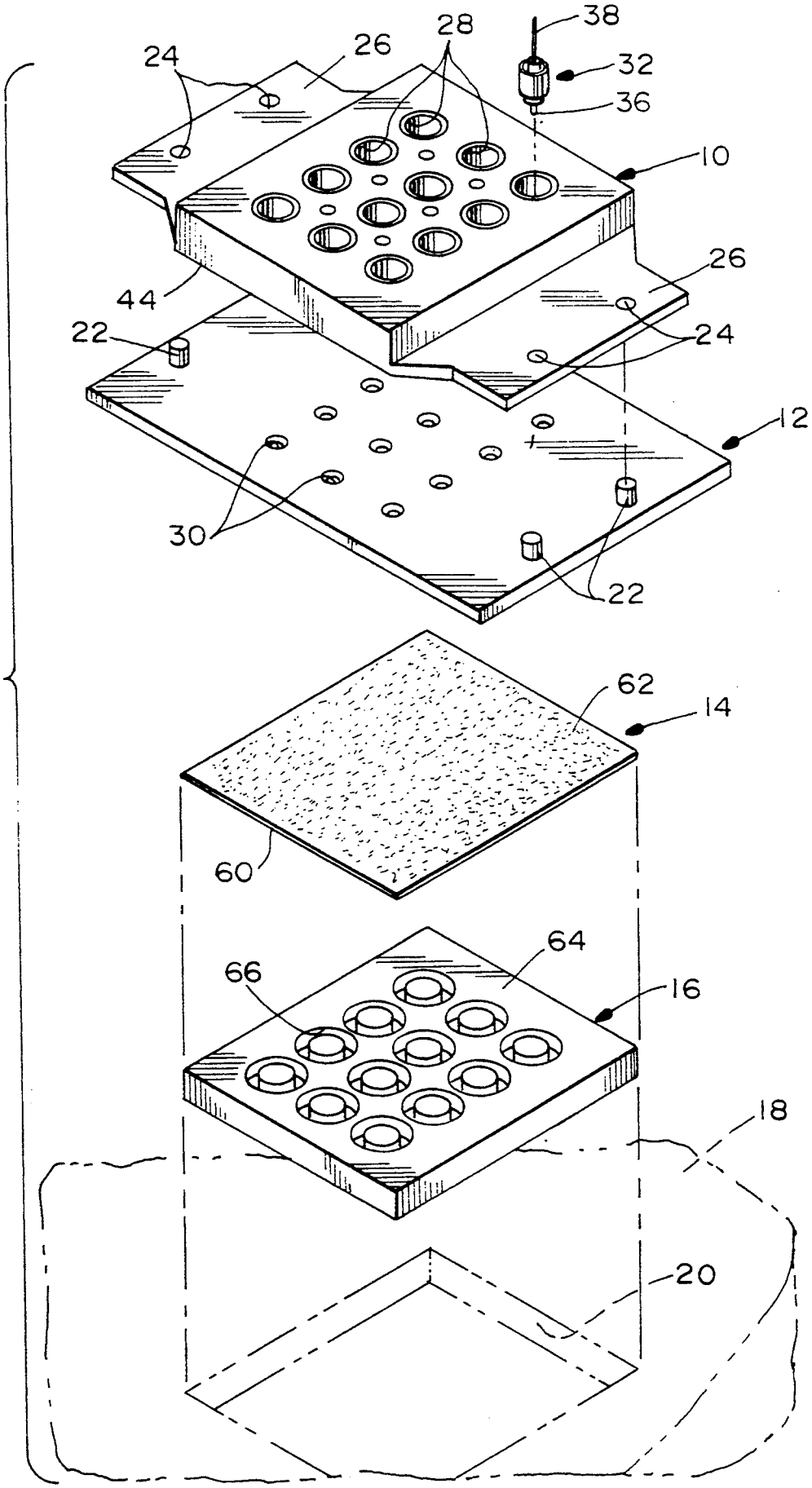
FIG. 1 is an exploded perspective view of the components of an optical fiber polishing apparatus incorporating the concepts of the invention.

Referring to the drawings in greater detail, and first to FIG. 1, the components of the optical fiber polishing apparatus of the invention are shown in an exploded perspective depiction. Specifically, the apparatus includes a mounting means or plate, generally designated 10, a positioning plate, generally designated 12, a polishing film, generally designated 14, and a polishing plate, generally designated 16. The polishing plate is shown above a support structure, shown in phantom at 18, which may have a recess 20 for holding the polishing plate.

The following detailed description of components 10–16 of the optical fiber polishing apparatus is being set forth in sort of a chronological order of using the various components during a polishing procedure. It is believed that this type of description is amenable to a better understanding of the functions of the structural details of the various components.

Figure 2:
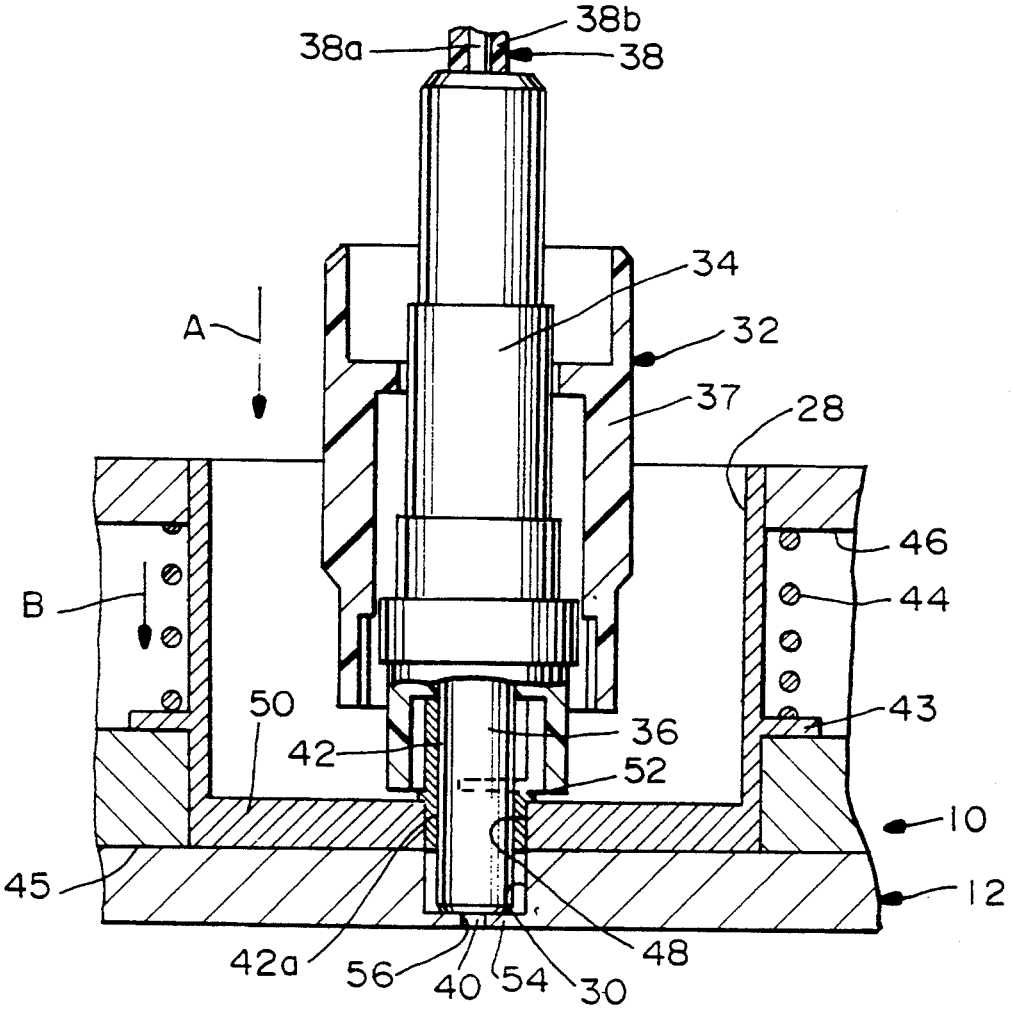
FIG. 2 is a fragmented vertical section through a fiber optic connector device mounted in the mounting means, or plate, of the apparatus and with the ferrule in engagement with a positioning plate of the apparatus.

Therefore, reference is made to FIG. 2 in conjunction with FIG. 1 where it can be seen that mounting means 10 is positioned in FIG. 2 on top of positioning plate 12. As seen in FIG. 1, the positioning plate has a plurality of upwardly projecting alignment bosses 22 which are received in corresponding alignment holes 24 in flanges 26 of mounting means 10. When mounting means 10 is properly located on positioning plate 12, with bosses 22 in holes 24, a plurality of locating sockets 28 in mounting means 10 are aligned with a plurality of positioning recesses 30 in positioning plate 12.

At this point, it should be understood that the entire polishing apparatus shown in FIG. 1 is designed to polish the ends of a plurality of optical fibers simultaneously. For instance, it can be seen that there are twelve locating sockets 28 in mounting means 10 in FIG. 1, and these locating sockets are alignable with twelve positioning recesses 30 in positioning plate 12. However, the following description, with reference to FIGS. 2–7, will be limited to the structure associated with polishing only a single optical fiber, with the understanding that the description is applicable for all twelve locations on the apparatus.

With that understanding, specific reference is made to FIG. 2 wherein it can be seen that a fiber optic connector device, generally designated 32, has been positioned downwardly in the direction of arrow "A" into one of the locating sockets 28. The fiber optic connector device is generally conventional and includes a body 34 and a forwardly projecting ferrule 36 of ceramic or other hard material. The connector includes a coupling nut 37 for coupling the connector to an adaptor for ultimate connection to a complementary connector. A fiber optic cable, generally designated 38, is encapsulated with in connector 32, with a length of an optical fiber **38*a*, stripped of its cladding 38*b*, extending through ferrule 36 so as to project slightly from the distal end of the ferrule, as with a fiber end 40** shown in FIG. 2.

Each locating socket 28, as seen in FIG. 2, includes a peripheral, radially outwardly projecting flange 43 for sandwiching a coil spring 44 between the flange and an interior surface 46 of mounting means 10. Therefore, the spring biases the locating socket forwardly in the direction of arrow "B".

Mounting means 10 further includes a receptacle in the form of a sleeve 42 which receives and grips ferrule 36 of connector device 32. This sleeve, in effect, provides the means for receiving and holding connector device 32, with ferrule 36 and fiber end 40 projecting below a forward face 45 of the mounting means.

Figure 4:
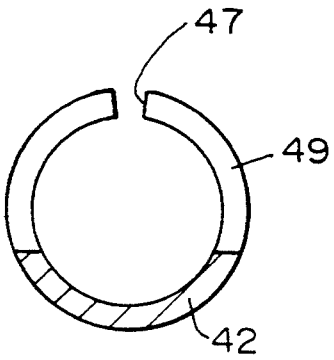
FIG. 4 is a section taken generally along line 4—4 of FIG. 3.
Figure 3:
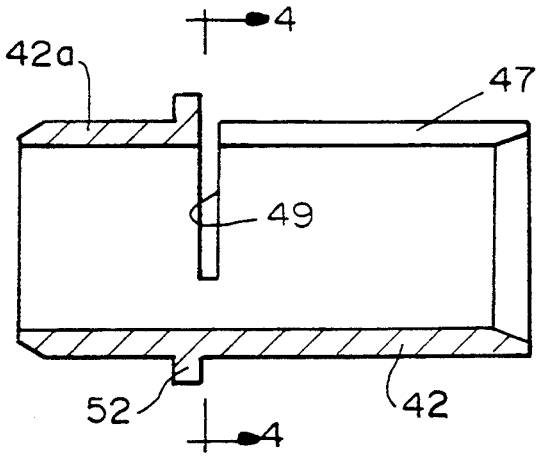
FIG. 3 is an axial section through the resilient sleeve for gripping the ferrule portion of the connector device.

Referring to FIGS. 3 and 4 in conjunction with FIG. 2, a feature of the invention is to provide a universal receptacle by structuring sleeve 42 to be axially slit, as at 47, and is radially slit, as at 49, to provide resiliency to grip ferrule 36. The forward portion **42*a* of the sleeve is cylindrical and is positioned into a hole 48 (FIG. 2) in a base wall 50 of locating socket 28. The sleeve is positioned in the hole by a force fit which is greater than the fit between the sleeve and ferrule 36. Therefore, ferrules can be inserted into and out of sleeve 42 without the sleeve moving relative to locating socket 28. Lastly, the sleeve has a radially outwardly projecting flange 52 which abuts against the top surface of wall 50** of the locating socket to properly position the sleeve relative to the socket.

Referring back to FIG. 2, again in conjunction with FIG. 1, each positioning recess 30 in positioning plate 12 includes a bottom wall 54 closing the recess, with a hole 56 in the bottom wall. The hole is of a size for fiber end 40 to project thereinto without interference.

In view of the above description of FIGS. 1–4, after mounting means 10 is properly located on top of positioning plate 12, with locating sockets 28 in the mounting means aligned with positioning recesses 30 in the positioning plate, a plurality of connector devices 32 are inserted into the sockets, with ferrules 36 inserted into sleeves 42. The connector devices are pushed downwardly in the direction of arrow "A" (FIG. 2), with ferrules 36 moving through sleeves 42 until the distal ends of the ferrules abut against bottom walls 54 of the positioning recesses. The result is that the ferrules, along with the projecting fiber ends 40, will project from forward face 44 of mounting means 10 a precise and consistent distance.

After the connector devices are properly positioned within mounting means 10, as describers. above, the mounting means, with the received connector devices, then is removed from positioning plate 12 and can be urged in conjunction with polishing plate 16 and polishing film 14 to polish the end faces of fiber ends 40. However, before proceeding with the polishing procedure, a description of polishing film 14 and polishing plate 16 will be described.

Specifically, polishing film 14 is fabricated of polyester material. An adhesive backing is applied to a back side 60 of the polishing film, and a lapping compound is applied to a forward side 62 of the film. The film thereby can be adhered to a forward surface 64 of polishing plate 16, whereby the polishing plate acts as a substrate for the film. The lapping compound on the forward side 62 of the film is effective for polishing the end faces of fiber ends 40. The adhesive on the back side 60 of polishing film 14 should be of a type so that the film can be removed from polishing plate 16, when worn, and be replaced with a new polishing film.

Referring particularly to FIG. 1, polishing plate 16 has a plurality (i.e. twelve) recessed grooves 66 corresponding in location and spacing to the twelve locating sockets 28 in mounting means 10. The recessed areas 66 are ring-shaped because mounting means 10 is used in a machine (which does not form part of this invention) which moves the mounting means over or relative to polishing plate 16 in a manner to effect an cycloid action. However, it should be understood that this ring-shape of recessed areas 66 is not to be limiting and, in the following description of FIGS. 5–7, a single recessed area in polishing plate 16 will be described.

Figure 5:
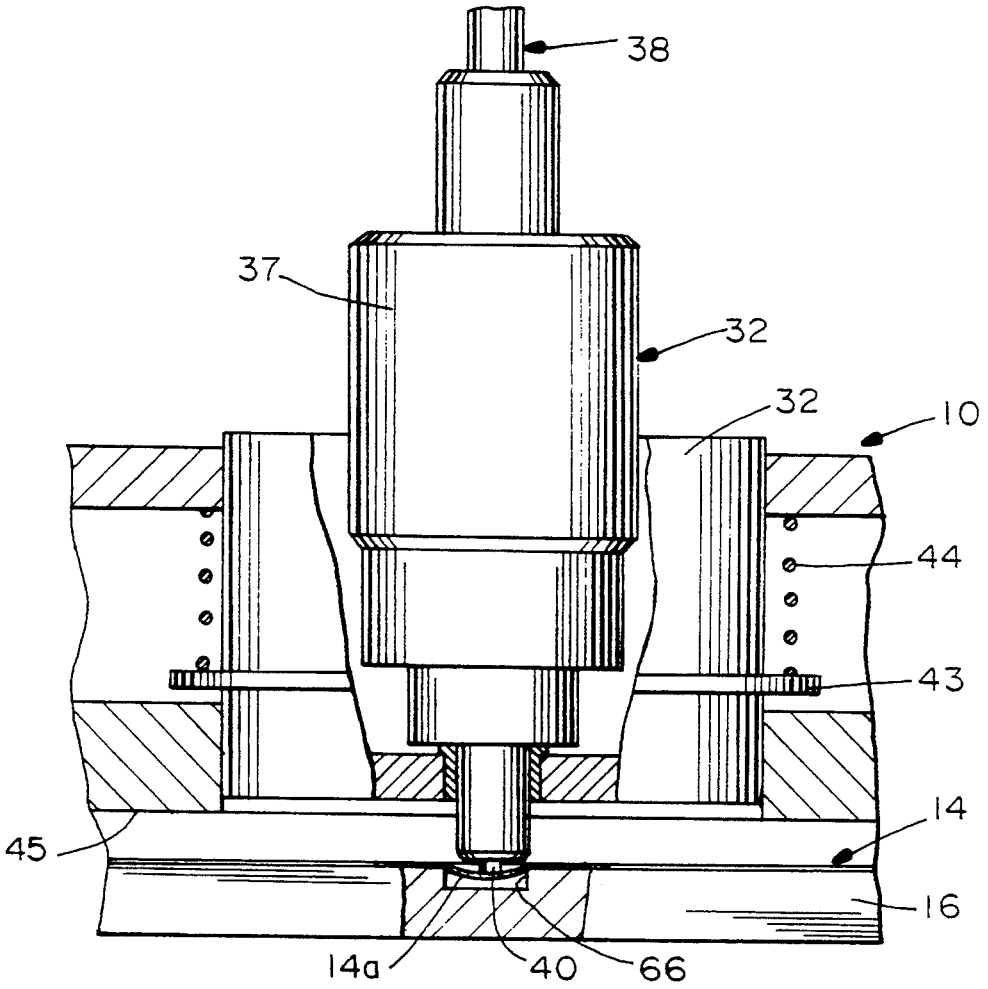
FIG. 5 is a fragmented vertical section through the mounting plate, similar to that shown in FIG. 2, but with a projecting optical fiber end in engagement with the polishing means.
Figure 7:
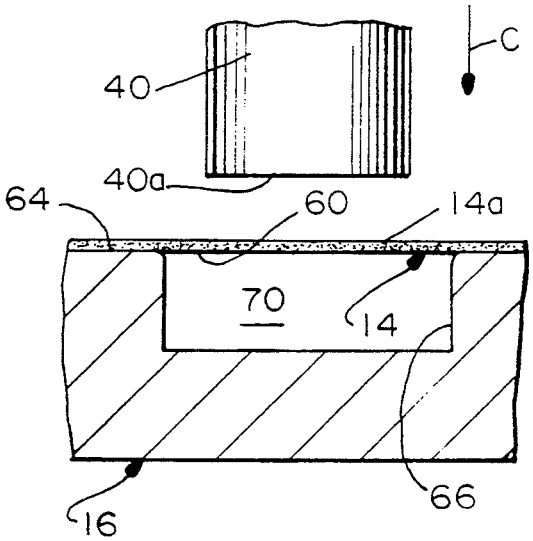
FIG. 7 is a view similar to that of FIG. 6, with the fiber end spaced from engagement with the polishing film.

More particularly, referring to FIG. 5, one of the locating sockets 28 in mounting means 10 is shown in alignment with a recess 66 in polishing plate 16, with a portion 14*a* of polishing film 14 spanning the recess. Reference is made to FIG. 7 wherein an enlarged depiction shows film portion 14*a* spanning recess 66 in polishing plate 16, and with a fiber end 40 about to be engaged with the film portion in the direction of arrow "C". It can be seen that an air space 70 is created beneath film portion 14*a* which spans recess 66. Since the film 14 is attached to surface 64 of polishing plate 16 by an adhesive backing, air present in air spaces 70 is confined within the spaces. This air effectively provides the cushioning or softening means for the film portion. It can be understood that the air, by nature, will not age or deteriorate as is prevalent with soft cushioning material heretofore used to provide flexibility in polishing surfaces.

Figure 6:
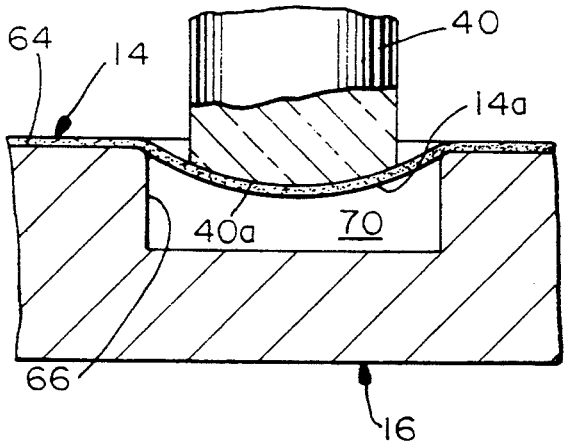
FIG. 6 is a fragmented section, on an enlarged scale, showing the area of FIG. 5 where the fiber end engages the polishing film.

Now, referring to FIG. 6 in conjunction with FIG. 5, it can be seen that mounting means 10 has been moved into proximity to polishing plate 16 so that fiber end 40 now is in engagement with the air-cushioned portion 14*a* of polishing film 14, spanning recess 66 in polishing plate 16. Fiber end 40 is pushed against the flexible film portion 14*a*, and spring 44 (FIG. 5) maintains a consistent pressure between the fiber end and the polishing film can be seen most clearly in FIG. 6, how the fiber end indents flexible film portion 14*a*. The resulting polishing action is to polish a convex surface 40*a* on the end face of the fiber end. This convex or spherical shape of the fiber end has become a standard, if not a requirement in the optical fiber industry. The convex shape provides a "contact spot" between abutting fiber ends in a pair of mating connector devices and eliminates the possibility of there being a gap between the fibers which would cause insertion or transmission losses.

Lastly, another distinct advantage of the aircushioned polishing film concept of the invention resides in the ability to precisely control the protrusion of the fiber over convex surface 40*a* (FIG. 6) which defines the end face of fiber end 40. In the progressive development of fiber optic connectors, the polished end faces of optical fibers have gone from flat surfaces to convex surfaces, and the radius of curvature of the convex surfaces has gone from sixty millimeters to thirty millimeters and presently down to as low as fifteen millimeters. With previous "soft" polishing surfaces, such as polishing surfaces backed by a resilient or foam medium, controlling the radius of curvature of the end face of the fiber end has become extremely difficult if not impossible. With the invention, the protrusion of the fiber is easily controlled simply by varying the size of the recessed area over which the flexible polishing film spans, in conjunction with simple control of the biasing means of the fiber end on the polishing film, such as spring 44. Obviously, a film spanning a large recessed area will be indented by a given pressure, at a smaller radius of curvature, than if the recessed area is significantly smaller.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An apparatus for polishing an end face of an optical fiber located within a ferrule portion of a fiber optic connector device the end face located on an end of the optical fiber projecting from the ferrule portion, comprising:

mounting means having a forward surface and a receptacle for mounting the connector device with the end of the optical fiber projecting from the forward surface to permit the end face to be polished by moving the mounting means over an appropriate polishing surface, wherein said receptacle is configured for receiving and holding the ferrule portion of the fiber optic connector device and comprises a resilient sleeve, wherein said sleeve is generally cylindrical and is at least in part axially and radially slit to provide resiliency for gripping the ferrule portion; and polishing means including a substrate having a recess in a forward surface thereof, and a polishing film on the substrate the polishing film having adhesive means on a back side thereof for adhering to the forward surface of the substrate, spanning the recess to define an air space in the recess beneath the film confining air present in the recess, whereby the mounting means can be positioned over the polishing means to align the end of the optical fiber with the recess, in engagement with the polishing film spanning the recess, to permit the end face of the optical fiber to be polished by moving the forward surfaces of the mounting means and the polishing means relative to each other.

2. The apparatus of claim 1 wherein said polishing film has a lapping compound on a forward side thereof for engagement by the end face of the optical fiber.

3. The apparatus of claim 1 wherein said mounting means include spring means for spring loading the receptacle to permit yielding of the receptacle and of the end of the optical fiber on engagement with the polishing film.

4. The apparatus of claim 1 wherein said mounting means include spring means effective to spring load the resilient sleeve to permit yielding of the resilient sleeve and of the end of the optical fiber on engagement with the polishing film.

5. In an apparatus for polishing an end face of an optical fiber located within a ferrule of a fiber optic connector device, the end face located on an end of the optical fiber projecting from the ferrule, the apparatus including mounting means having a forward surface and receptacle means for mounting the connector device with the end of the optical fiber projecting from the forward surface to permit the end face to be polished by moving the mounting means over an appropriate polishing surface, wherein the improvement comprises said receptacle means including a resilient sleeve wherein said sleeve is generally cylindrical and is at least in part axially and radially slit to provide resiliency therefor for gripping the ferrule of the connector device.

* * * * *